United States Patent [19]

Young, II

[11] 4,003,169

[45] Jan. 18, 1977

[54] ANCHOR SYSTEM

[76] Inventor: Elliott B. Young, II, Rte. 1 Box 77, Edwards, Ill. 61554

[22] Filed: Jan. 12, 1976

[21] Appl. No.: 648,570

Related U.S. Application Data

[63] Continuation-in-part of Ser. No. 532,255, Dec. 12, 1974, abandoned.

[52] U.S. Cl. ..... 52/155; 24/269; 52/23; 254/164

[51] Int. Cl.[2] ..... B66F 13/00; E02D 5/80

[58] Field of Search ..... 52/23, 153–165, 52/149; 254/161, 164; 24/269

[56] References Cited

UNITED STATES PATENTS

| | | | |
|---|---|---|---|
| 610,184 | 9/1898 | Hill | 52/155 |
| 1,248,470 | 12/1917 | Eggleston | 52/156 |
| 1,311,335 | 7/1919 | Foulke | 52/155 |
| 2,712,864 | 7/1955 | Clevett, Jr. | 52/155 |
| 3,080,024 | 3/1963 | Clevett | 52/155 |
| 3,139,163 | 6/1964 | Haller | 52/155 |
| 3,242,623 | 3/1966 | Brisse | 52/155 |
| 3,808,756 | 5/1974 | Cooper et al. | 52/23 |
| 3,881,694 | 5/1975 | Gardner | 24/269 X |

*Primary Examiner*—J. Karl Bell
*Attorney, Agent, or Firm*—Cushman, Darby & Cushman

[57] ABSTRACT

An improved anchoring system for use with regard to a wide variety of materials including an improved anchor head which is very easily and quickly turned over and oriented within the material in which it is embedded. The anchor head is comprised of a triangular or wedge-shaped plate having a deformed central area extending from the front driving point to the rear edge. At least a portion of the rear part of the anchor head is provided with an angular bend forming wings or flaps which provide the improved turnover capability. The system also comprises a self-tightening bracket, an anchoring cable and a drive rod for embedding the anchor head.

7 Claims, 5 Drawing Figures

Fig. 2.
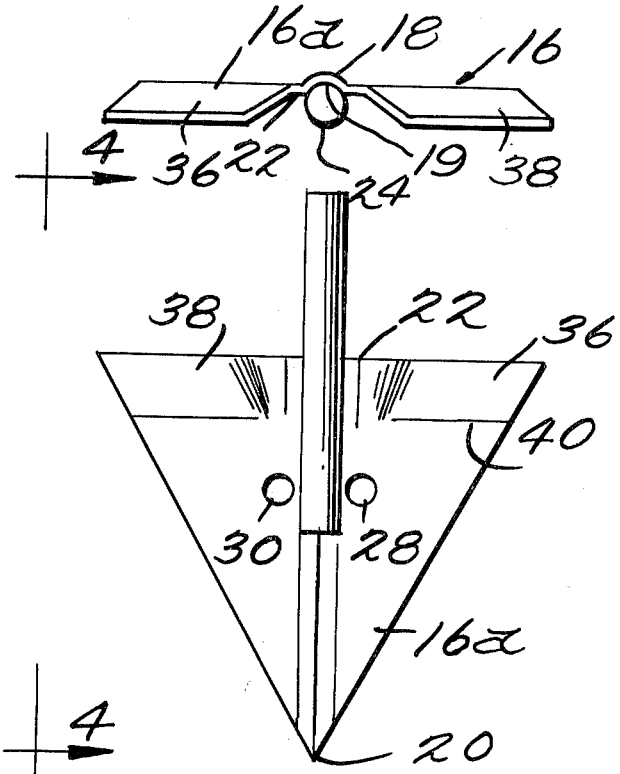
Fig. 3.
Fig. 4.
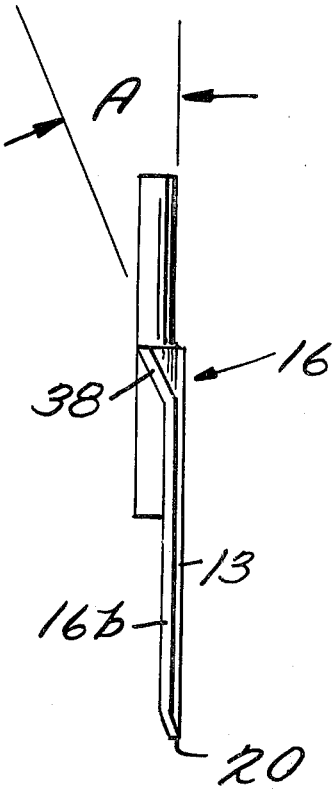
Fig. 5.
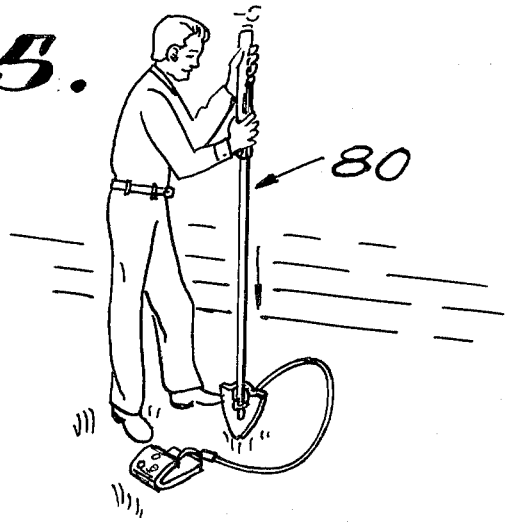

ANCHOR SYSTEM

BACKGROUND OF THE INVENTION

The present application concerns an improved anchoring system and anchor head device and is a continuation-in-part application from a copending application U.S. patent application Ser. No. 532,255 filed on Dec. 12, 1974 now abandoned.

The anchor described in the present application concerns a novel means for anchoring a number of items such as machinery, mobile homes, trailers, aircraft, fences and sign posts, or any other type of item which is usually thought of as requiring an anchor to retard movement. The anchor disclosed in this present application will usually be used to fix items to the ground along with a number of other like anchor systems, but use of the anchor head as described in the present invention is not limited thereto. Specifically, it is contemplated by the applicant that the anchor head could also be used, for example, as the pointed end of a spear gun so as to provide a point more readily anchorable within a fish, or anywhere else it would be desirable to anchor a once embedded item.

Apart from anchoring methods which include the digging of holes and the burying of large precast anchors made from stone or other substances, the most widely employed devices are portable in that they can be easily carried to the desired anchoring site and there installed. Therefore, such anchoring systems must be light in weight, easily transportable by the user, usable in a variety of circumstances and quickly installable.

Portable types of anchoring devices are known to exist in the prior art. For example, Hill, U.S. patent Ser. 610,184 discloses an anchor usable for securing posts and discloses a conically-shaped anchor head having a concave upper face. The anchor itself, however, will make a rather large hole as it is driven into the ground which will retard the effectiveness of the anchor unless that hole is subsequently filled.

Another is Foulke, U.S. Pat. No. 1,311,335 which shows a crescent-shaped anchor and a fairly complicated installation tool. The anchor is left in a horizontal position in the ground by means of the action of the installing tool and there is no teaching that the anchor itself can provide the necessary flip-over action required to orient the anchor head so the head may provide effective anchoring.

Other examples of prior art ground anchors are disclosed in the following patents:

| | |
|---|---|
| Clevett, Jr. | U.S. Patent 2,712,864 |
| Clevett | U.S. Patent 3,080,024 |
| Haller | U.S. Patent 3,139,163 |
| Brisse | U.S. Patent 3,242,623 |

Each of these patents shows essentially an equilateral triangle shaped ground anchor head which can be driven into the ground, and which upon having tension applied thereto will turn over, i.e., orient itself to a position or plane substantially at right angles to the direction from which tension has been applied to a cable secured to that anchor. It is essential, however, that when orienting the anchor head no play or slack be created in the cable or that such play or slack be minimized. The elimination of play can only be achieved if the anchor can turn over very quickly. Further, if during turnover the anchor head is moved a substantial distance toward the surface of the material in which it is embedded, its effectiveness will be minimized. The greater the distance required for the anchor to turn over properly, the greater amount of cable which is pulled from the ground. This will produce greater amounts of slack in the cable connecting the anchor to the object being held and as the head moves closer to the surface, reduce the amount or thickness of ground holding the anchor head.

Clevett, Jr., U.S. Pat. No. 2,841,256, also discloses a ground anchor which employs a pivotal anchor portion of the anchor head which has been provided with a curved surface or recess to assist the tipping motion of the anchor head. That recess is not well defined and does not effectively use the rear edge. A substantial surface area along the rear edge is not affected by nor part of the recessed portion. This surface area is flat and will tend to retard the effect of the recess thereby allowing the anchor head to move toward the ground's surface during orientation of the head, lessening the amount of earth against which the anchor head is effective. Thus, the possibility of creating play or slack in the system exists and the anchoring potential of the head has been minimized.

The present invention relates to an improved ground anchor head comprised of a relatively thin, flat material which is provided along its rear edge with flaps or wings which cause the anchor head, upon the application of tension to an anchor cable attached to the anchor head, to rapidly turn over, i.e., become oriented, in the material in which the head has been embedded. The turnover or orientation of the head places the upper surface of the anchor head substantially perpendicular to the direction of pull thereon and thereby presents a large substantially planar face with which to resist the pull or tension forces placed on the anchor cable. When the anchor system is in use, the other end of the anchor cable is connected to a clamping device which connects the anchor system to the item being held in place by means of a holding strap or band. The clamping device automatically provides greater clamping pressure on the holding strap as tension on the holding strap is increased thereby improving the effectiveness of the system.

The anchor head is deformed in the area extending from the front point to the rear edge so that a centrally located ridge, which bisects the anchor head, is formed on one side thereof while a channel is formed on the other side of the anchor head. A rod-like neck or bar is attached to the anchor head within the previously formed channel so that a portion of that bar protrudes beyond the rear edge. This neck or bar can be connected to a driving rod for purposes of embedding the anchor head into the ground. Should the head, however, be used with other apparatus, the neck or bar could, for example, be removably secured to a spear gun shaft.

The anchor head is also provided with two apertures through which the anchor cable is threaded. The apertures are positioned essentially in the center of the anchor head, or at the centroid thereof, and also positioned so that the cable will pass around the portion of the neck or bar secured to one side of the anchor head. Since the apertures are positioned at the centroid of the anchor head or substantially at the center thereof, the pulling force placed on the oriented anchor head will be distributed substantially symmetrically thereover, so as to achieve the maximum anchoring effect possible.

In order that the present invention may be readily understood, reference is made to the accompanying drawings, which schematically illustrate, by way of example, the preferred embodiment thereof, and in which:

FIG. 2 shows a rear elevational view of the anchor head;

FIG. 3 shows a plan view of the anchor head of FIG. 1;

FIG. 4 shows a side elevational view of the anchor head, taken along the line 4—4 in FIG. 3.

FIG. 5 shows the anchor head attached to the drive rod.

Figure 1:
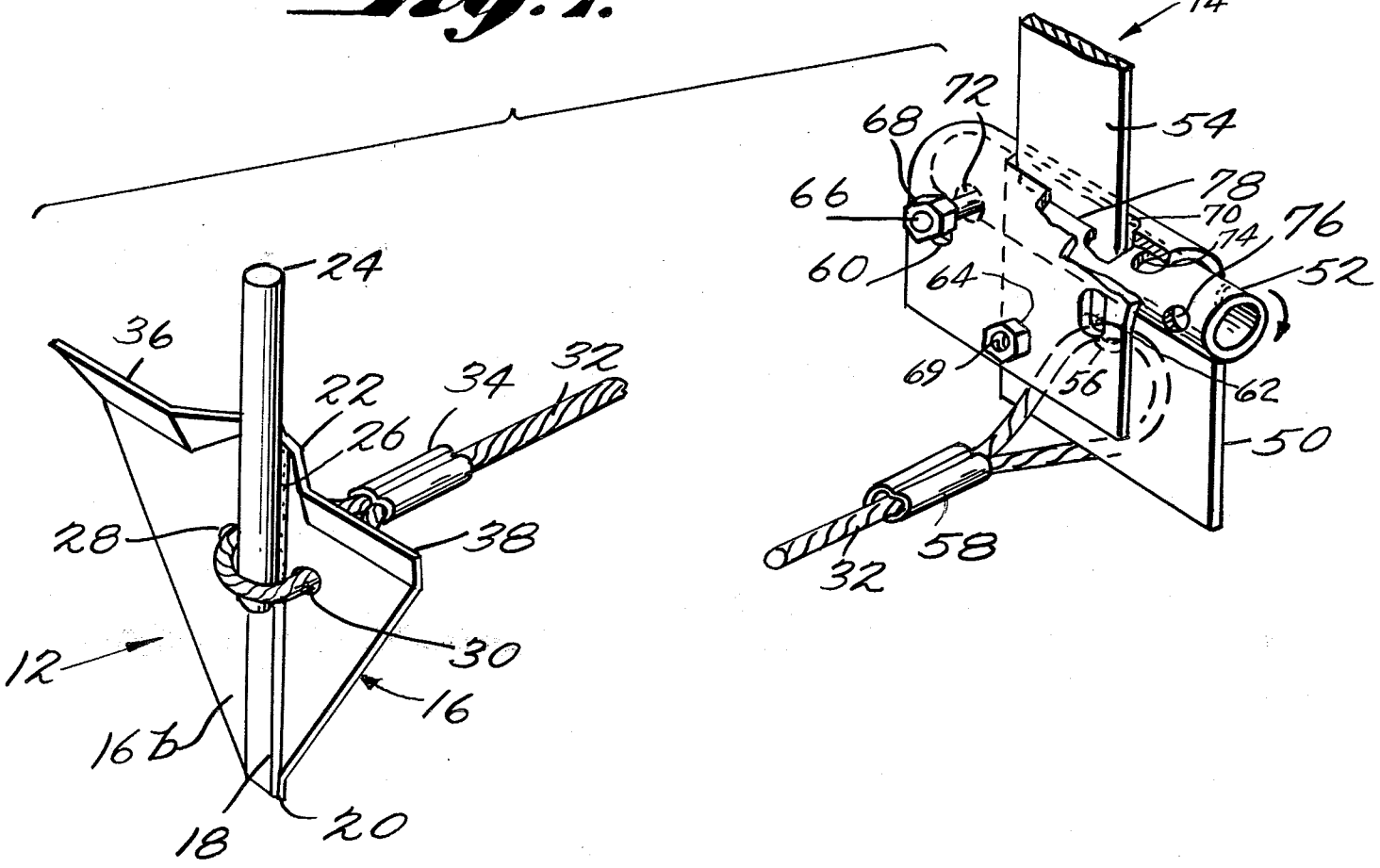
FIG. 1 shows the anchor and clamp system according to the present invention.

Referring now to FIG. 1, the anchor system according to the present invention is generally indicated at 10 and is comprised of an anchor generally indicated at 12, a clamp generally indicated at 14 and a connecting cable 32.

The anchor is comprised of a head 16 having top and bottom sides **16*a* and 16*b*, respectively. The head 16 is wedge shaped, generally in the form of an equilateral triangle, although other shapes may also be used. The anchor head 16 is deformed along a line extending perpendicularly from the rear edge 22 to the front point 20 so that a rib 18 is formed on one side of the anchor head 16 and a channel 19 is formed on the opposite side. In addition, the front point 20 acts as the driving point during the embedding process. In order to aid the deflection of the anchor head 16 around relatively small objects in the ground such as small rocks, the front point 20, as shown in FIG. 4, is slightly angled upwardly away from the plane formed by the top side 16*a*. The rib 18 and channel 19 together not only provide strength to the anchor head 16 so that the head 16 will not bend as it is driven into the ground, but also receives a rod-like neck or bar 24 is welded at 26 or otherwise secured within channel 19 so that a portion of bar 24 extends beyond rear edge 22**.

The anchor head 16 may be fabricated from any available material which possesses a high tensile strength and is formable into the shape required by the present invention. Steel, such as steel coated with zinc in accordance with ANSI 119.1 is preferred but aluminum or high resistance plastics can also be used. However, regardless of the material used it is essential that the material exhibit a corrosion resistance relative to the soil or other material in which the anchor head is to be embedded.

The anchor is usually sized according to and as a function of the amount of holding force required and the nature and condition of the material in which it is to be embedded in a given application. The larger the surface area of the anchor the greater the holding force. One anchor head 16 found to be generally acceptable for anchoring mobile homes in conjunction with six or more other anchor systems spaced around the home, is formed as a 6 inch equilateral triangle from 12 gauge steel having the following dimensions: head thickness ⅛ inch (0.2 to 0.4 centimeters), head length (from 0.20 to the rear edge 22) 5⅛ inches (13 centimeters), head width (length of rear side 22) 6 inches (15 centimeters), hole diameter ⅜ inch spaced 1¾ inches for the rear edge 22 and spaced ⅝ inch from the center of rib 18; neck diameter ½ inch, length 4½ inches, protruding 2⅜ inches beyond the rear edge 22. These and any other dimensions are merely illustrative and are not to be construed as being limiting as regards the present invention.

The neck 24 can be formed from a solid rod of cold rolled steel with a diameter of a half-inch and a length of approximately 4½ inches. As shown in FIG. 1, approximately half of rod 24 is attached to head 16 while the remaining half extends beyond rear edge 22. Further, the rod 24 is preferably welded to the head at 26 such that the welded end extends from rear edge 22 toward point 20 beyond a line connecting the centrally located apertures 28 and 30. A conventional steel anchor cable 32 is threaded through apertures 28 and 30 with the free end of cable 32 subsequently anchored back onto itself by a clamp 34. It should be understood that while cable 32 is preferably steel, other types of cable such as nylon could likewise be used. The other end of cable 32 is connected to the clamp assembly 14.

Apertures 28 and 30 are preferably positioned at or near the centroid of head 16 and sufficiently centrally so as to distribute pulling forces transmitted by cable 32 roughly uniformly across the top side **16*a* of anchor head 16**.

In addition, apertures 28 and 30 are preferably placed on opposite sides of the rib 18 and the neck 24 so that pulling forces are equally distributed with respect to the axis formed by rib 18. Likewise, apertures 28 and 30 are placed between the front drive point 20 and the rear edge 22 so that the pulling forces applied by cable 32 on the anchor head 16 are roughly equally distributed symmetrically along the axis formed by rib 18. Thus, once the anchor head 16 is oriented perpendicularly to forces transmitted by cable 32, it keeps that orientation and provides continued maximum resistance within the material in which it is embedded.

As was mentioned previously, it is important that the anchor head 16 have the abiltiy to turn over in the ground quickly and be easily oriented in response to forces transmitted by the anchor cable 32. When oriented, the plane formed by head 16 will have assumed a position substantially perpendicular to the direction of the force on cable 32. When orientation is accomplished quickly, little or no play is generated in the cable and the anchor head 16 will remain at substantially the same location below the surface of the ground or other material in which it was embedded as when the head was initially embedded.

In order to achieve rapid turn-over and referring again to FIG. 1, the rear portion of anchor head 16 has been shaped so as to form flaps or wings 36 and 38. As shown in FIGS. 2 and 4, wings 36 and 38 each extend along approximately one-third of the length of rear edge 22. As shown in FIG. 4, wings 36 and 38 are bent downwardly away from the horizontal plane formed by the top side **16*a* of the anchor head 16** by an acute angle A which is in the range of 10° to 40°. A more preferred range for angle A is 20° to 30°, with a preferred angle being 25°.

The bend line 40 for wings 36 and 38 is located approximately 1 inch from the rear edge 22 in the specifically dimensioned embodiment described above and the rear portion of each of wings 36 and 38 extends along the rear edge 22 for approximately 2 inches.

Referring again to FIG. 1, the clamp assembly 14 is comprised of an essentially J-shaped clamp member 50, a strap securing shaft 52, on which a strap 54 is wound and bolts 66.

The clamp member 50 is provided with an aperture 56 through which the anchor cable 32 will be threaded with the cable 32 being secured back onto itself by means of clamp 58. The clamp member 50 is also provided with three pairs of opposing openings 60, 62 and 64, which are sized so as to receive a bolt such as is shown at 66 which is held in place, as for example, by nut 68.

The clamp member 50 is also provided with an elongated slot 70 located along the bent or upper portion thereof, through which the securing strap 54 can pass.

The strap securing shaft 52, which can be either a solid or hollow shaft, is provided with apertures 72, 74 and 76, sized to allow bolts 66 to pass therethrough. Shaft 52 is also provided with an elongated slot 78. Slot 78 is positioned along the length of the shaft 52 so that when shaft 52 lies within clamp member 50 slot 78 will lie directly adjacent the slot 70. Aperture 74 is circumferentially offset from apertures 72 and 76 by 90°, so that when shaft 52 is rotated to tighten strap 54, one or the other of apertures 72 or 74 will respectively be in alignment with opening 60 or 62 in clamp member 50 thereby allowing bolt 66 to pass therethrough to initially hold shaft 52 in a tightened condition.

The clamp member 50 can be approximately ⅛ inch thick and can be formed from a piece of 12 gauge steel or any other convenient material and can, for example, be approximately 7 inches long and 3½ inches wide prior to being formed into its J-shape. When formed into the J-shape, the front or short side of the J-shaped clamp member 50 can extend down from the area of the bend approximately 2½ inches while the rear or long side extends downwardly from the area of the bend approximately 3½ inches. The slot 70 is positioned substantially equidistantly from each side edge of clamp member 50 in the area of the bend.

It will be noted that when the strap securing shaft 52 is positioned within clamp member 50 as in FIG. 1, the shaft 52 will extend beyond the edge of the clamp member 50 and that opening 76 is located within that extended portion of shaft 52. A turning rod (not shown) can be inserted through opening 76 to assist in rotating shaft 52 within the clamp member 50 when tightening strap 54.

The operation and installation of the anchor system according to the present invention would preferably be as follows. After it had been determined where the anchor head 16 should be placed and following the threading of cable 32 through apertures 28 and 30, along with securing cable 32 with clamp 34, anchor head 16 is connected to a drive rod 80 and the anchor head 16 will be positioned against the ground as shown in FIG. 5. Thereafter, anchor head 16 is forced into the earth by any convenient means such as by pounding drive rod 80 with a hammer (not shown) or by using a pneumatic hammer. The anchor head 16 can be driven into the ground at any angle and in most instances it would be most convenient to drive the anchor head 16 vertically as in FIG. 5.

Preferably, the anchor head 16 will be driven into the ground until the clamp assembly 14 is approximately at ground level at which point drive rod 80 can be removed.

The anchor head 16 can be left in an unoriented position and cable 32 secured through the clamp assembly 14 to the item to be held or the head 16 can be immediately oriented.

Applicant has found that best results are achieved if the anchor is oriented at this point in time which is possible to accomplish because of the presence of wings 36 and 38. The orientation of anchor head 16 can be accomplished by placing a standard car jack (not shown) or any other lifting device along the bottom edge of the clamp member 50, below the aperture 56. When the clamp 58 has been moved vertically approximately 2 inches, the anchor will have been completely turned to its proper oriented position parallel with the ground.

The strap securing shaft 52 will be inserted into the clamp member 50 and the free end of the securing strap 54 will be placed through the slot 70 of the clamp member 50 and into the slot 78 of the securing shaft 52.

A suitable turning device can now be inserted into aperture 76 and shaft 52 rotated in a clockwise direction, as shown by the arrow in FIG. 1, until the securing strap 54 has been tightened so that all slack is taken out of cable 32 and either aperture 72 or 74 is in alignment with aperture 60 or 62, respectively. Thereafter, a bolt 66 can be inserted through the aligned openings. After the bolt 66 has been inserted through the appropriate openings and the nut 68 has been placed thereon, the nut 68 will be tightened. Thereafter, further turning of shaft 52 will be impossible. A bolt 69 can then be inserted through the pair of apertures 64, as is shown in FIG. 1, and tightened to the greatest extent possible so as to effectively deform clamp member 50 against strap 54. Thereafter, when tension is placed on strap 54 that tension will tend to move strap 54 and shaft 52 in a counterclockwise direction. Since strap 54 is in contact with the interior surface of clamp member 50, the counterclockwise force exerted by the tension on strap 54 will tend to cause further tightening of the clamp member 50, as was initially effected by means of the bolt 69. Thus, clamp member 50 will automatically cause additional compression against the strap member 54. Such additional compression will cause, in turn, additional holding power to aid in keeping the strap 54 from pulling loose.

It is believed that if the anchor head 16 was unoriented the tightening of the strap 54 within the clamp assembly 14 would cause at least partial orientation with full orientation being quickly achieved thereafter upon the transmission of force to head 16 along cable 32.

It will now be clear that there is provided a system including an improved anchor head which accomplishes the objectives heretofore set forth. While the present invention has been disclosed in a preferred form, it should be understood that the specific embodiment thereof as described and illustrated herein is not to be considered in a limited sense, but there may be other forms or modifications of the invention which should also be construed to come within the scope with the appended claims.

What is claimed is:

1. An anchoring system including an anchor member comprising a solid wedge-shaped head having top and bottom sides bounded by a rear edge and two side edges, said side edges tapering to a front point, a centrally positioned channel extending from the front point to said rear edge, said head being provided with two holes therethrough, the holes being substantially equally spaced from the centroid of said head and from said channel, a rod-like neck secured to one side of said head within said channel, so that a portion of said neck protrudes beyond said rear edge, wherein at least part of the rear portion of said head is bent so as to form at least one wing along at least a portion of said rear edge, said wing being positioned on each side of said channel, a self-tightening clamp comprised of an essentially J-shaped clamp member provided with a plurality of apertures extending therethrough and at least one elongated opening extending therethrough, a strap securing shaft provided with a plurality of apertures, and at least one elongated opening therein, bolt means for securing said shaft within said clamp member, a cable attached to and extending between said anchor member and said clamp, and drive pole means for engaging the portion of said neck extending beyond said rear edge and for embedding said anchor member.

2. An improved anchor head comprising a thin, wedge-shaped head having top and bottom sides, bounded by two side edges and a rear edge, said side edges tapering to a front point, means for securing an anchor line to said head so that tension forces exerted along the anchor line are distributed substantially uniformly across said head, means for embedding said head, said embedding means being secured to one of the sides of said head, wherein at least a portion of the rear of said head is bent angularly in the direction of said bottom side so as to form at least one wing along at least a portion of said rear edge.

3. An improved anchor head as claimed in claim 2 wherein the rear portion of said head is bent downwardly from the plane formed by the top side of said head at an angle of from about 10° to about 40°.

4. An improved anchor head as claimed in claim 3 wherein said angle is 25°.

5. A self-tightening clamp for use with securing straps comprising: an essentially J-shaped clamp member having a short side and a long side each with an interior and exterior surface; means defining a slot located along the bent portion of said J-shaped clamp member joining said long and short sides for receiving the securing strap; securing means for securing said J-shaped clamp member to an anchoring cable, a strap securing shaft on which the strap can be wound, said shaft being rotatably mounted interiorly within said J-shaped clamp member parallel to the slot; means to engage at least a portion of the interior surfaces of said short and long sides with the securing strap wound on said shaft so that as tension is applied on the securing strap in a direction opposite to the direction in which the securing strap is wound on said shaft, said short side is moved into tighter engagement with the securing strap.

6. A clamp as claimed in claim 5 wherein certain ones of said plurality of apertures in said shaft are offset circumferentially from the other ones of said plurality of apertures.

7. A method of forming an anchor head comprising the steps of:

forming a flat wedge-shaped head having two side edges tapering together so as to form a front driving point and a rear edge;

deforming said head so as to form a rib on one side of said head and a channel on the other side of said head, said rib and said channel extending between said front point and said rear edge;

securing at least a portion of a rod within said channel so that a remaining portion of said rod extends beyond the rear edge of said head;

bending the rear portion of said head so as to form wings on each side of said rod; and forming two apertures equally spaced from the centroid of said head and from said rod.

* * * * *